US007423367B2

(12) United States Patent
Lantis et al.

(10) Patent No.: US 7,423,367 B2
(45) Date of Patent: Sep. 9, 2008

(54) DESIGN OF HIGH POWER PULSED FLASH LAMPS

(76) Inventors: Robert M. Lantis, 42879 Glyndebourne Ct., Ashburn, VA (US) 20148; Boris Zlotin, 5095 Virgie La., West Bloomfield, MI (US) 48324; Peter Ulan, 750 Amenia Dr., Wolverine Lake, MI (US) 48390; Vladimir Proseanic, 2252 Keylon Dr., West Bloomfield, MI (US) 48324; Gafur Zainiev, 7067 Westbury Blvd., West Bloomfield, MI (US) 48322

( * ) Notice: Subject to any disclaimer, the term of this patent is extended or adjusted under 35 U.S.C. 154(b) by 0 days.

(21) Appl. No.: 11/466,798

(22) Filed: Aug. 24, 2006

(65) Prior Publication Data

US 2007/0046167 A1 Mar. 1, 2007

Related U.S. Application Data

(60) Provisional application No. 60/710,866, filed on Aug. 25, 2005.

(51) Int. Cl.
*H01J 19/12* (2006.01)

(52) U.S. Cl. ..... 313/238; 313/288; 313/17; 315/111.71

(58) Field of Classification Search ..... 313/311, 313/238, 631, 288, 17, 284–286, 567, 605, 313/634; 315/246, 260, 111.71
See application file for complete search history.

(56) References Cited

U.S. PATENT DOCUMENTS

| | | | | |
|---|---|---|---|---|
| 5,808,402 | A * | 9/1998 | Seiler et al. | 313/318.01 |
| 6,153,968 | A * | 11/2000 | Dombrowski et al. | 313/238 |
| 6,249,077 | B1 * | 6/2001 | Brown et al. | 313/25 |
| 6,274,973 | B1 * | 8/2001 | Mochiduki et al. | 313/318.09 |
| 7,187,111 | B1 * | 3/2007 | Johanning | 313/238 |
| 2005/0218773 | A1 * | 10/2005 | Ono et al. | 313/311 |

* cited by examiner

*Primary Examiner*—Douglas W. Owens
*Assistant Examiner*—Jimmy T Vu

(57) ABSTRACT

Broadband output high power pulsed flash lamps are useful in many applications, and when specifically optimized, can become an excellent source of ultraviolet (UV) light, which is particularly useful for photo-chemically-induced materials processing applications. Multiple factors involved with the production of high-energy light pulses can in certain cases adversely affect the ultraviolet lamp operation, thereby resulting in the development of micro cracks in lamp envelopes and subsequent limitation in lamp lifetime. Similar factors can be responsible for an increased absorption of UV radiation by lamp components and degradation of lamp efficiency. This invention describes new pulsed flash lamp designs that enable a new generation of high power and performance as required by, for example, many large-scale photo-processing applications. This invention uniquely and advantageously mitigates the development of micro-cracks and failure, and produces dramatically improved electrical efficiency, stability of lamp optical characteristics, and service lifetime.

25 Claims, 13 Drawing Sheets

DESIGN OF HIGH POWER PULSED FLASH LAMPS

RELATED APPLICATION

This patent application claims priority to U.S. Provisional Application No. 60/710,866 filed Aug. 25, 2005, which is herein incorporated by reference in its entirety.

FIELD OF THE INVENTION

The present invention relates to pulsed flash lamp designs for producing high performance and very high power (peak and average) pulsed broadband light, as well as lamps for producing pulsed ultraviolet (PUV) light. Specifically, the present invention relates to lamp designs that reduce lamp degradation and breakage, and provide improved lamp cooling, and electrical-to-optical output efficiency of the desired spectral emission band.

BACKGROUND OF THE INVENTION

It is known that system designs for high power flash lamps typically include the following components: 1/Lamp envelope or lamp tube made of tubular material with adequate transparency for the desired spectral emission band(s) (e.g., UV-grade quartz for UV radiation), and filled with gas or gases such as xenon, krypton, or other suitable gas(es); 2/Electrodes located in opposite ends of the tube, connected to a source of high voltage and producing an electrical discharge in the gas(es); 3/Surrounding jacket or second tube of suitably transparent material around the circumference of the lamp envelope, providing a volume for circulation of cooling fluid (gas or liquid) between the lamp exterior surfaces and the internal surface of the jacket. Such cooling fluid providing removal of excess heat developed during the lamp operation.

While there are many known styles and methods for operating pulsed flash lamps, it is most common for high power pulsed lamp operation to encompass some version of the three typical operating modes: an ignition mode, a simmer mode, and a pulse mode. The ignition mode provides initial ionization of gas inside the tube by a special igniter. The simmer (standby) mode is provided by a small current that supports a constant low level of gas ionization inside the tube. The pulse mode is produced by a short, high peak power and high voltage discharge inside the tube, the discharge having a duration between microseconds and milliseconds, and developing pulses with peak power from one to hundreds of megawatts.

The growing demand by new applications for increased UV processing power has in many instances required much improved flash lamp performance over the capabilities of the generation of PUV lamps prior to this invention. Compared to previous pulsed lamp designs, this new generation of high power and performance pulsed lamps is physically characterized by a much longer length anode-to-cathode spacing (for example, by a factor of three or more), with a subsequent increase in the length, weight, and aspect ratio profile of the lamp. Compared to previous pulsed lamp designs, this new generation of high power and performance pulsed lamps is electrically characterized by pulses with larger currents (peak and/or average magnitude), longer arc lengths (anode-to-cathode spacing), and higher required operating voltages. In order to extend both power and performance capabilities beyond the pre-existing generation of so-called medium-to-high power flash lamps, new methods and designs are required. For example, large-scale water disinfection and remediation is just one application where the older generation of PUV lamps have shown to be lacking, and therefore not considered by industry to be entirely suitable to the task. A new generation of higher power and performance pulsed ultraviolet lamps is both desirable and advantageous. UV light can effectively disinfect across a broad range of targeted pathogens. In sharp contrast with chemical disinfectants such as chlorine, UV light can disinfect without adversely affecting the taste, odor, or safety of the water, and is particularly effective against protozoa, such as Cryptosporidium Parvum. Additionally, pulsed UV systems in particular advantageously can deliver a consistent UV light output efficiency despite any lamp and/or ambient temperature changes, and instant UV power "ON" and "OFF" cycling, instantly variable and precise levels of UV power output throughout the range of zero to 100%. Importantly, PUV can do so with neither the hazardous mercury, nor the explosive potential created by high lamp envelope temperatures and pressures that characterize conventional continuous wave (CW) medium pressure UV lamps. Furthermore, it is known that the CW mercury lamps (among others) have an inherent problem of performance degradation due to thermal gradient induced fouling (minerals attraction) of lamp cooling jackets. Therefore, it is advantageous to create pulsed UV systems with the capability to fulfill the requirements of large-scale UV processing applications.

It is known by practitioners of the art that the previous generation of PUV lamps, while demonstrating very attractive potential advantages and benefits, have never successfully been deployed on a large scale, and were seemingly relegated to laboratory work and/or relatively low power niche applications. Known problems have included unacceptably short service life, uncompetitive electrical-to-optical output efficiency, inconsistent UV output, and UV spectral and power outputs that are not well-matched to the targeted application. The records show that lamp service lives were limited by one or more combinations of rapidly-declining UV output, excessive lamp aging that degraded and then prematurely prevented operation, and/or catastrophic failure of the lamp envelope material. Electrical-to-UV output efficiencies were within the range of 5% to 9%, which compares unfavorably with the approximate practical range of 17% to 35% typical of CW mercury UV lamps. The UV output of the previous generation of PUV lamps became progressively less consistent (in terms of energy per pulse and spectral characteristics) with eventually unsuccessful attempts to push towards higher output powers.

The primary reason for these limiting problems is that neither the lamp designs, nor the pulsed power supply designs, are substantively different from the conventional flash lamp technology that has been in use for many decades in relatively lower performance systems. A thorough survey of prior art reveals that there exist no novel departures from standard pulsed lamp designs that enable scaling of the technology into the performance and power levels that today are desirable for certain applications. Indeed, the designs of pulsed lamp systems that fail to meet the more recently extended performance criteria are, in essence, identical to the designs traditionally used in smaller, less demanding, and lower performance systems.

Practitioners of the art are aware of the long-established body of knowledge concerning the various standard techniques for designing and driving pulsed flash lamps. While these techniques tend to work well within the broad base of established applications for which these designs have been incorporated, it is now known that the simple extension of these standard designs and methods into the more demanding class of very high power PUV lamps has been shown to be insufficient for the task.

In order to achieve the potential advantages of very high power pulsed UV lamps, it is necessary to create new and unique lamp designs by which this technology is enabled, thereby inventing a whole new generation of higher capability and performance pulsed lamps. The design methods for the older generation of lower performance and power flash lamps are inadequate to the task; this invention provides necessary solutions.

There are multiple causes for the potentially deleterious stress to which this new generation of high performance pulsed lamps may be subjected, such as compression and tension induced stress, thermal expansion and contraction induced stress, tensile stress resulting from induced deformations, asymmetrical heating and deformation of the envelope resulting in a bending of the lamp envelope, and resonance oscillations.

For example, a typical characteristic of pulsed flash lamps is that, beginning with the onset of the main current pulse, the discharge consists of a thin cathode sheath (cathode "glow", negative glow, and so-called "dark spaces") and a positive column that fills most of the anode-to-cathode space. At the higher lamp pressures, this cathode sheath is less than a micron thick, but has a pressure, applied voltage, and current-independent voltage drop of approximately 150 Volts. Although the sheath-dissipated power is small because of the shallow depth of the sheath, the power dissipated per unit volume is very high, resulting in instantaneously high temperatures and pressures, and the subsequent formation of a strong shock wave. This initial strong shock wave is attenuated within a few millimeters, depositing much of its energy in the region surrounding the electrode, including the lamp envelope. The power of the main pulse that is subsequently deposited into the main column between the anode and cathode rapidly heats the plasma along the length of the bore, thereby creating a cylindrical shock wave that travels to the envelope wall, reflecting and oscillating several times at very high acoustic frequencies (≈100 kHz).

According to both theoretical calculations of and empirical data from pulsed flash lamp operation, very high power pulses can produce high forces that create compression and tension stresses in lamp materials. In particular, the high power pulses produce gas heating and pressure increase, axial and radial forces, and shock waves through the gas and tube walls. As a result: 1/axial waves propagate through the gas and envelope, completely or partially reflected from tube ends and can produce a set of multiple reflected waves that interfere and create standing waves and stress points in the envelope walls; and 2/radial waves propagate through the gas, envelope walls, cooling fluid and cooling jacket, traversing through boundaries with different material properties, completely or partially reflected back and create standing waves and various stress points in the envelope walls.

Thermal expansion and contraction induced stress is created due to fast pulse gas heating that produces transient thermal loading upon the inner layer of the lamp envelope. The envelope outer layer is cooled down by outside coolant flow, which results in a temperature gradient through the tube walls and additional pulse tension stress in the envelope outer layer.

Deformations in the envelope material can result from high peak inner pressures, combined with heating and softening of the envelope inner layer. Fast cooling of the thermally-conductive quartz or glass produces hardening of deformed material and creation of compression stress in inner layers along with tension stress in outer layers of the envelope. This effect is similar to the known method of treatment of artillery cannon barrels (autofrettage) when high internal hydraulic pressure improves the barrel resistance during firing. Very small changes during each short pulse can accumulate and produce sufficient tensile stress in the tube outer layer, tube elongation and bending, which could become an additional source of tensile stress on the bulging side.

Emanating from the plasma and external lamp wiring, and in some designs also affected by surrounding component layout, high current-induced electromagnetic fields can produce asymmetrical shifting of the plasma filament away from the lamp axis and toward one side of the envelope wall. This can result in asymmetrical heating and deformation of the envelope. Accumulation of deformations and stress after multiple pulses can result in eventual bending of the lamp envelope.

Lastly, multiple high power pulse sequencing with constantly changing pulse repetition frequencies from single to thousands per second (depending on system design and operating conditions) can create a resonance effect in lamps with natural frequencies in the same range. The move towards the use of dramatically longer length lamps aggravates this situation. Resonance oscillations in a lamp can produce detrimental pulsing tension and compression stresses in lamp components. These and other mechanisms of stress development can accumulate in lamp envelope material(s) and work in combination. It is known that tube-shaped materials (quartz or glass) behave much like other hard and brittle substances; they work very well under compression, but are very sensitive to tension stress. Multiple tension cycles exceeding a critical level of stress can be responsible for a gradual development and emergence of micro-cracks in the material, leading to catastrophic breakage of the lamp. Another effect of stress and micro-cracks accumulation is the degradation of tube transparency (increased absorption of radiation by the envelope walls), and subsequent reduction of lamp electrical-to-optic output efficiency.

There is therefore a need for a reliable and cost-effective lamp system design and method of manufacture that can prevent lamp breakage and/or premature degradation of desired radiation output.

SUMMARY OF THE INVENTION

Accordingly, a primary object of the present invention is to provide a reliable and cost-effective lamp design and method of fabrication, thereby preventing lamp breakage due to the forces created by high power electrical pulses.

A further object of this invention is to provide lamp designs and methods of manufacturing that improve the lamp stability in terms of envelope material degradation and reduction of its optical characteristics.

These and other objects are achieved in the present invention.

The present invention overcomes the dilemma caused by accumulation of small deformations in the materials comprising the pulsed flash lamp components, eventually resulting in the development and emergence of micro-cracks, degradation of envelope optical properties and lamp efficiency, and in some cases leading to lamp breakage.

Accumulation of small deformations in lamp envelope components come as the result of stress produced by multiple high power pulses of high voltage discharge inside the lamp tube.

These pulses are responsible for: pressure increase inside the tube; heating of tube inner walls; thermal expansion of lamp components; generation of shock waves through the tube working gas; propagation of axial and radial shock waves through the lamp components; resonance oscillation of lamp components; and lamp tube elongation and bending.

The pulsed flash lamp of the present invention addresses the issues of degradation of strength and transparency of lamp components by providing, for example: better lamp envelope shape, cross-section and material distribution, thereby resulting in greater resistance of the envelope to the combination of forces produced by multiple pulse high power loading; connection points between the tube and envelope that improve lamp rigidity and strength; selective tube/envelope connections and material distribution that focuses on prevention of dangerous tube resonant oscillations; special means to reduce tension load in the tube walls (pressurized cooling fluid, axial and radial preload, etc.,); methods to limit tube axial compression forces in order to prevent bulging (sliding tube holders, etc.,); various methods of shock waves absorption, suppression, and redirection in order to reduce harmful high peak pulse loads upon the relevant lamp components; and various combinations of the afore-mentioned techniques in order to successfully utilize the desirable qualities of certain lamp envelope (tube) materials in situations where the tensile characteristics of those same materials would otherwise be unacceptable for the new generation of high power and performance pulsed lamps.

The combination of features of the present invention provides a reliable and cost-effective lamp design and method of manufacturing, preventing lamp breakage by forces of high power electrical pulses, and improving the optical transparency and stability of lamp materials.

There has thus been outlined, rather broadly, the more important features of the invention in order that the detailed description thereof that follows may be better understood, and in order that the present contribution to the art may be better appreciated. There are, of course, additional features of the invention that will be described further hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that equivalent constructions insofar as they do not depart from the spirit and scope of the present invention, are included in the present invention.

For a better understanding of the invention, its operating advantages and the specific objects attained by its uses, reference should be had to the accompanying drawings and descriptive matter which illustrate preferred embodiments of the invention.

BRIEF DESCRIPTION OF THE DRAWINGS AND THE FIGURES

DETAILED DESCRIPTION OF THE INVENTION

Figure 1:
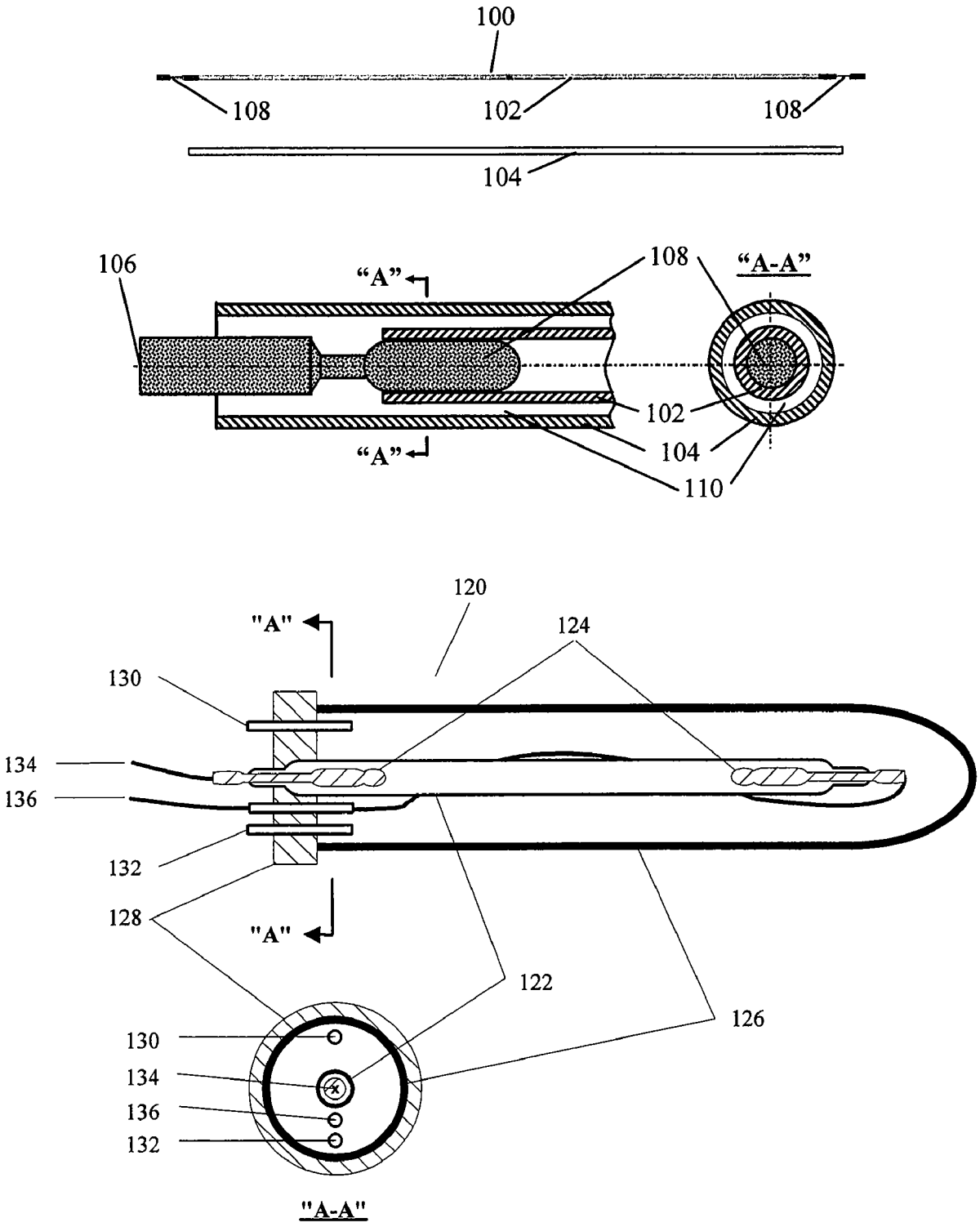
FIG. 1 illustrates both a high power and performance pulsed ultraviolet flash lamp and a conventional flash lamp.

FIG. 1 illustrates an example of the new generation of high power and performance pulsed ultraviolet (PUV) flash lamp 100, along with an example of the previous generation of lower performance capability flash lamp 120. The new generation flash lamp 100 comprises a central envelope or tube 102 of material transparent to UV radiation. Such materials are known by those of ordinary skill in the art. In a preferred embodiment, the central envelope comprises UV-grade quartz. The tube volume is filled with a working gas such as known by one of ordinary skill in the art and including but not limited to xenon or krypton.

Electrode(s) 108 are hermetically inserted in the ends of lamp tube 102, and are electrically attached by means of lamp connectors 106 to an electrical power source, preferably a high voltage pulsed power source, thereby enabling the production of an electrical discharge in the working gas. The electrode anode-to-cathode distance, or arc length, of perhaps 100 cm or more, is uniquely much longer than that of the previous generation flash lamp 120; for a given pulse energy, this length advantageously reduces by a factor of approximately three or more the thermal loading per cm length of lamp tube 102 compared to that of the older generation pulsed lamp 120.

Cooling jacket or second tube 104 comprising suitably transparent material is located around the lamp circumference as shown by detailed cross-section A-A, creating annular channel 110 between the lamp and walls of cooling jacket 104. The cooling fluid is pumped along lamp tube 102 through channel 110 and removes the excess heat developed during lamp 100 operation.

The previous generation of lower performance capability flash lamp 120 is characterized by a much shorter electrode anode-to-cathode distance, or arc length, typically on the order of 25 cm to 35 cm. For a given pulse energy, this shorter distance between electrodes 124 creates a factor of approximately three or more greater thermal loading per cm length of lamp tube 122 than that of the new generation lamp 100. Common configurations include cooling fluid inlet 130 through a feed through plate or flange 128, a cooling fluid circulation volume surrounding lamp tube 122 and enclosed by cooling jacket 126, cooling fluid outlet 132 through feed through plate or flange 128, pulsed power source feed through connection 134 to lamp electrode 124, and ground current return connection 136 from the oppositely situated lamp electrode 124.

High power pulses during lamp operation are responsible for gas pressure increase and heating, development of axial and radial forces in tube material, and shock waves through the gas and tube walls. As a result, the accumulation of high peak stresses in the envelope material (quartz or glass) could lead to a degradation of envelope shape, strength, the development of micro-cracks, and premature failure.

FIGS. 2, 3, 4, and 5 illustrate an embodiment of the present invention, wherein the lamp is reinforced by introduction of an improved envelope/tube design, thereby providing better resistance to bending and tensile stress in the envelope material and improved heat transfer and control of cooling fluid flow.

Figure 2:
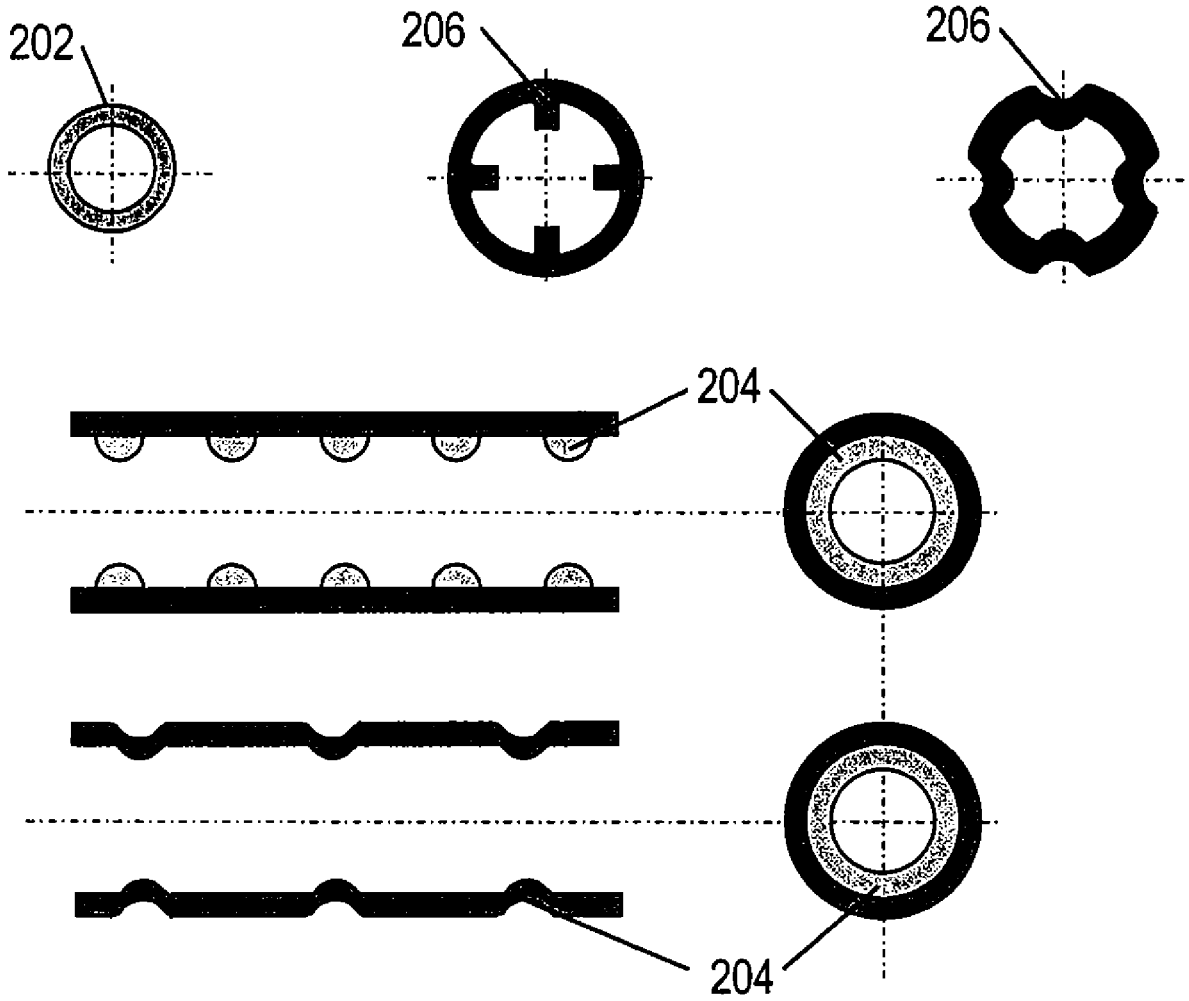
FIG. 2 illustrates a means for increased lamp envelope rigidity.

FIG. 2 illustrates examples of lamp envelope (or tube) designs. For comparison, conventional previous generation (lower power and performance) tube 202 is shown. Unique and advantageous lamp envelope designs include tubes with ribs located on their outer and/or inner surfaces, tubes with depressions located on their outer and/or inner surfaces, and non-round tubes. Tubes with reinforcing ribs and/or depressions can be formed in the shape of annular ring or spiral elements, as illustrated by radial tube 204. Tubes with reinforcing ribs and/or depressions can also be formed longitudinally along the tube centerline, as illustrated by longitudinal tube 206. Similarly, longitudinal and radial ribs made by deformation of quartz or glass tube walls can provide an additional improvement in envelope physical strength and a reduction of problems related to bending, stress concentration, and shock waves suppression. Further, such ribs and/or depressions can be discontinuous. In alternative embodiments the tube can instead be comprised of similar constructions that are instead formed as external protrusions instead of internal indentations.

Figure 3:
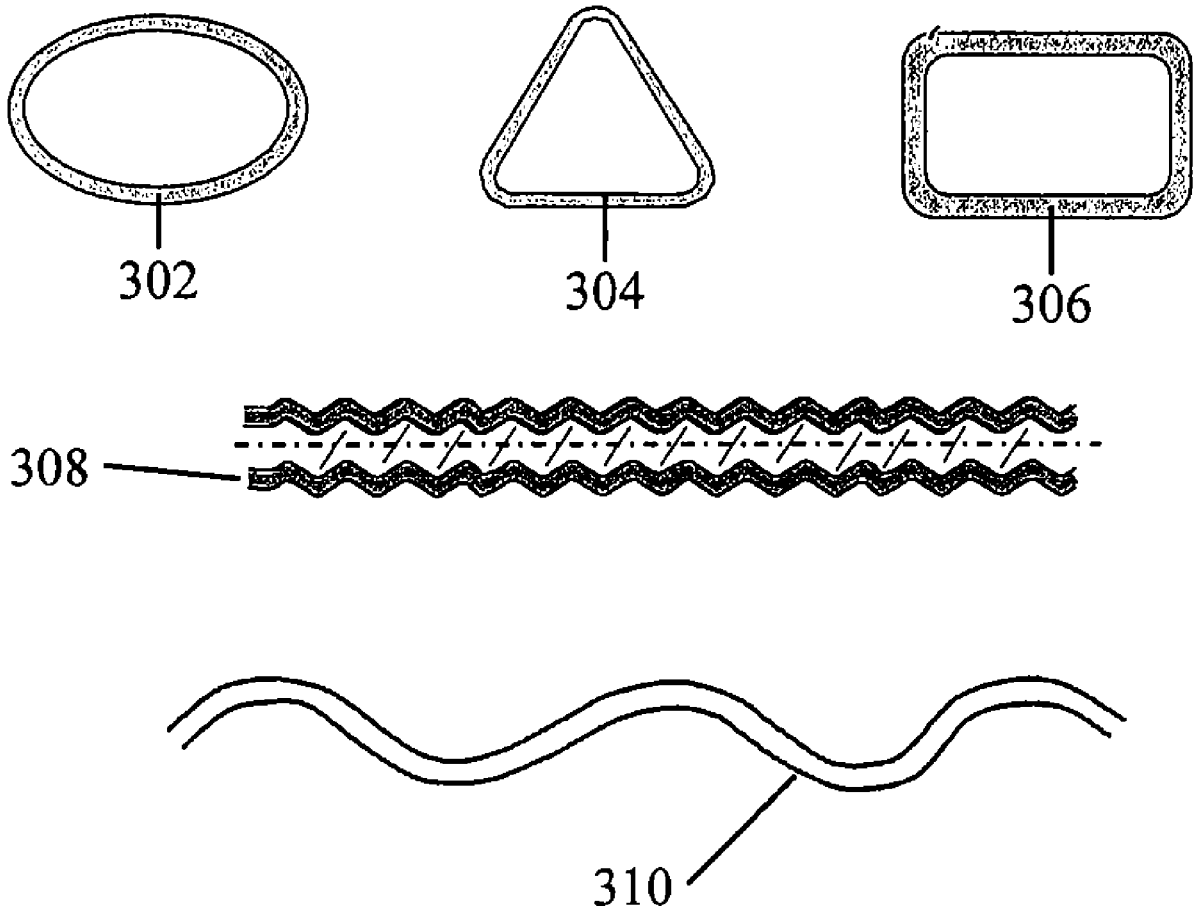
FIG. 3 illustrates examples of non-round lamp tube shapes.

FIG. 3 further illustrates improved envelope/tube designs, wherein the pulsed flash lamp is made with the envelope cross-section comprised of a non-round shape. Non-round tube cross-sections include but are not limited to elliptical or oval 302, triangular 304, rectangular 306, polyhedron, polyhedron with rounded corners, diamond, and other shapes. Non-round tube cross-sections usually have higher modulus of inertia and can provide better resistance to bending in specific direction. Non-uniform volume of tube in different directions creates some additional tube space, thereby helping to disperse vibration and reduce the harmful effects of shock waves.

The application of twisted 308 and wave-like 310 components to lamp tubes can improve the tension-induced stress fatigue characteristics of the lamp. Envelopes with constantly changing acoustic-reflecting sides provide good means for suppression and redirection of shock waves propagated through the working gas along the length of the tube.

Figure 4:
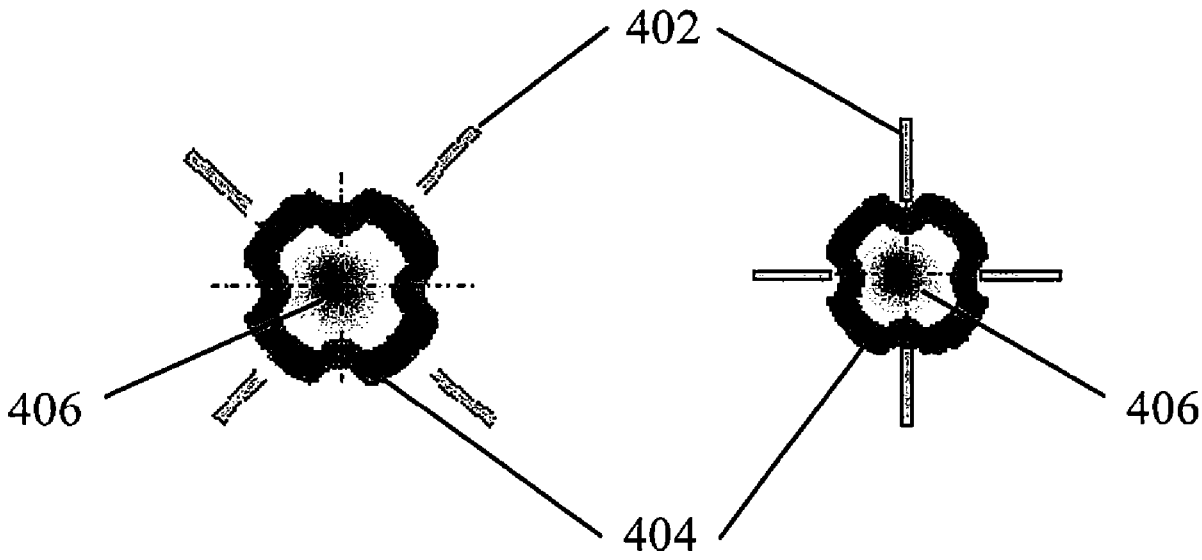
FIG. 4 illustrates flash lamp tubes having spiral longitudinal wall depressions.

FIG. 4 illustrates flash lamp tubes having spiral longitudinal wall depressions. This improvement can simultaneously provide several opportunities for better performance and lifetime. For example, the extra gas volume that is created between tube depressions can serve as pressure absorbing chambers that reduce and redirect shock waves generated by high peak power pulse discharges in the lamp gas. At the same time, the electrical proximity effect of the depressions can advantageously be utilized to optimize the electron density (and therefore, the temperature) of the plasma channel. The electrical field shape is influenced by the size, distance, and shape of the high dielectric envelope material that surrounds the plasma. The depressions can therefore also provide better axial position control of the plasma filament, whereby the inside depression will tend to concentrate the plasma filament toward the lamp centerline, assisting to localize it within the center of the envelope.

Cross-sectional views in FIG. 4 also illustrate the addition of ground return current bars 402. Preferably such ground current return bars 402 are a symmetrical array of external metallic conductors, reverse current direction to and coaxial with plasma channel 406 contained within lamp envelope (or tube) 404. The electromagnetic field produced by the addition of appropriately located ground current return bars (carrying reverse-direction ground current) will act to stabilize lamp plasma 406 into the desired central axis position of tube 404. By this invention, the multiple parallel conductor ground current return arrangement can provide the advantages of a single, solid coaxial return line (low inductance and EMI shielding), but without the disadvantage of losses produced by such single coaxial return line when utilized with high peak and average power electromagnetic fields. This arrangement interrupts the normally large circumferential current return loop (tangent to the plasma), whereby such circumferential current return loop electrical losses become detrimental in the presence of high current electric fields. Thus such return conductors are constructed as a substantially current-loop-free radial array of parallel conductors located coaxially about the plasma. Furthermore, the radial-positioned array of conductors can be carefully and advantageously placed at locations where their electric field interaction with ambient dielectric components and with the plasma will help shape the plasma. The spatial location, cross-sectional shape, size, proximity to surfaces, and electron current densities of the plasma can all be advantageously optimized for a given application. For example, ground current return conductors can be located at a particular distance form the plasma to optimally locate the plasma along the central axis of the lamp bore. Additionally, ground current return conductors can be located at a particular distance from the plasma in order to optimally achieve a desired plasma current density and/or plasma temperature. As another example, ground current return conductors can be located with respect to intermediary dielectric materials and their associated electric field-shaping characteristics in order to optimally achieve a desired plasma current cross-section shape, size, and/or electron density. Optimization including but not limited to the above cited examples can be readily determined in view of the instant disclosure by one of ordinary skill in the art. Therefore, various combinations of radial parallel coaxial ground return bars can also influence the plasma temperature and subsequent spectral output of the lamp. Alternate embodiments substitute other shapes in place of the conducting bars, such as rods or sheets, with the aforementioned additional desirable results made possible by the interacting effects of the plasma and return currents electromagnetic fields in combination with both the shape and proximity of the conductor material and the shape and proximity of the dielectric material (quartz tube).

Figure 5:
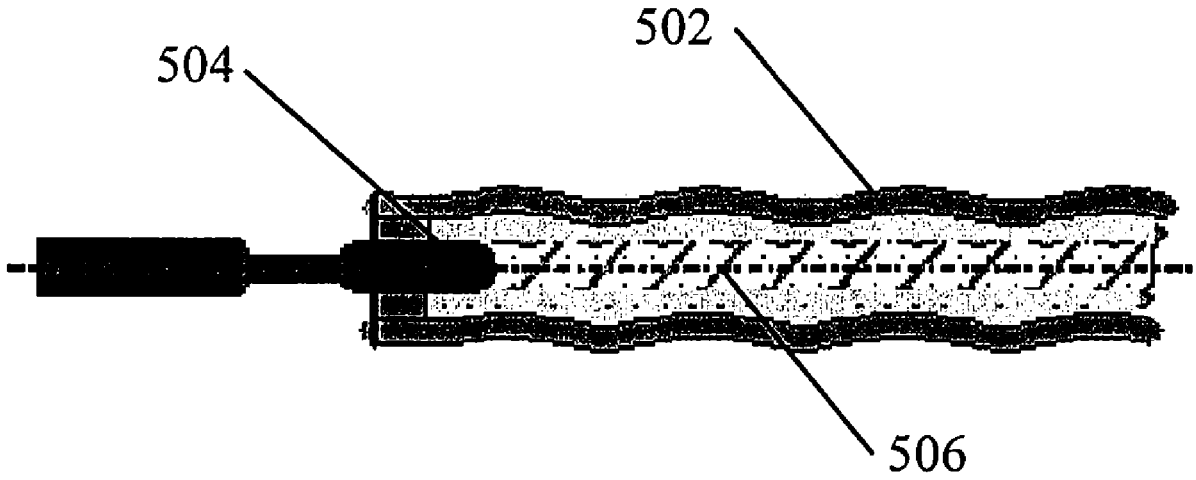
FIG. 5 illustrates a means for increased heat exchange.

FIG. 5 illustrates the use of structural modifications to lamp envelope 502 in a manner that provides improved control of cooling fluid flow, thereby resulting in improved heat transfer from the lamp. Shown is a tangential cross-section view of one end of a pulsed lamp, showing lamp envelope or tube 502, electrode(s) 504, and plasma discharge region 506. Heretofore smooth-walled lamp envelopes disadvantageously maximize the laminar flow of cooling fluids along the external surface of the lamp, so the fluid boundary layer is increased, turbulence decreases, and heat transfer efficiency reduces. This invention eliminates this problem by the use of irregular surface shapes that do not adversely affect the transmission of optical output, yet simultaneously increase the cooling fluid turbulence along the critical surfaces of thermal contact. By so increasing the efficiency and rate of thermal exchange, the average and peak temperatures of the lamp envelope can be lowered, thereby increasing the power and performance capabilities of the pulsed lamp. Judicious choice of location of such elements upon the lamp envelope can be used for improvement of heat transfer through the tube walls and for control of cooling fluid flow through the channel between the lamp envelope and cooling jacket, including the creation of higher turbulence zones at the hottest areas of the lamp. In order to improve coolant turbulence, lamp envelope surfaces and/or tube ribs can be made in the form of discontinuous elements and/or wave-like surface structure, and can be located only where required in order to achieve in those locations the thermal conditions required for any specific high performance pulsed lamp design.

It is understood that multiple combinations of lamp envelope reinforcement elements can be used with different lamp surface modifications in each of various specific applications.

Figure 6:
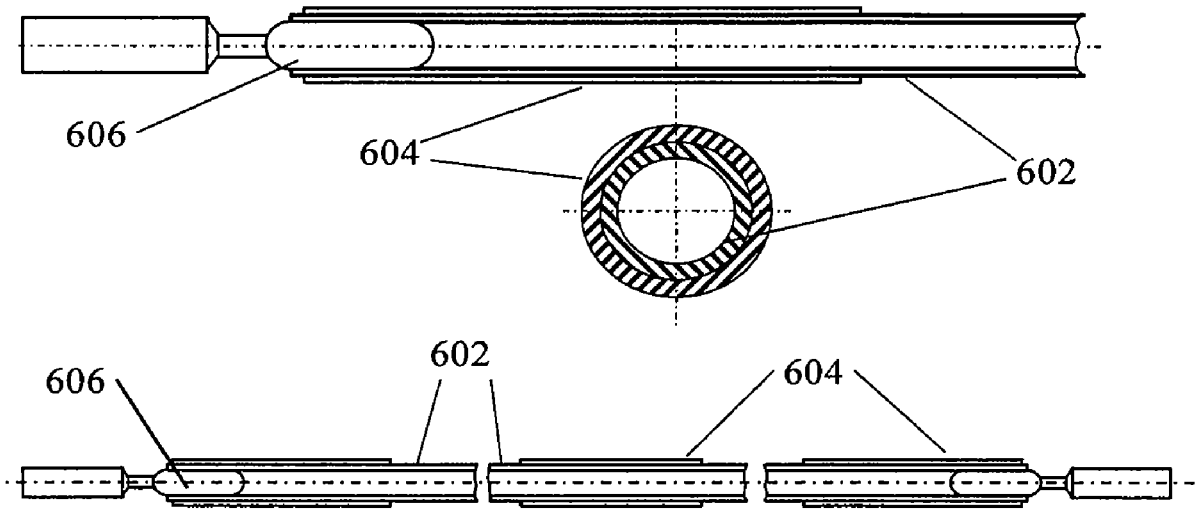
FIG. 6 illustrates a double layer lamp tube.

FIG. 6 illustrates another embodiment, wherein UV lamp tube 602 is reinforced by introduction of an envelope design with secondary reinforcing sleeve 604 over and/or inside the original envelope. A suitable tight fit between tube 602 and reinforcing sleeve 604 can reduce the level of stress in the tube material and provide a beneficial effect upon the flash lamp lifetime.

Multi-wall tube(s) of at least two layers of envelope material assembled with preloading, allow control of the stress direction and level (for example, reduced tension in tube inner layer). Further, providing area(s) of contact of the at least two wall adjacent components can achieve an attenuation of radial shock waves, redirecting them back inside the tube, and reducing the stress level on the exterior of the tube. In this manner, certain areas requiring additional support, for example, the region surrounding electrode(s) 606, may be advantageously strengthened without imposing what might be a detrimental effect upon other less-stressed locations. Various combinations of this method can improve the lamp envelope lifetime.

Multi-wall tubes can be used partially in areas affected with a higher thermal or mechanical load, such as hot electrode zones or high stressed envelope central area. Thus, such multi-wall tubes can be discontinuous. For example, in one example multi-wall tubes are used near electrode(s) 606 and/or along lamp tube 602. Use of such multi-wall tubes results in an increased envelope lifetime with less modifications and fewer future problems.

Figure 7:
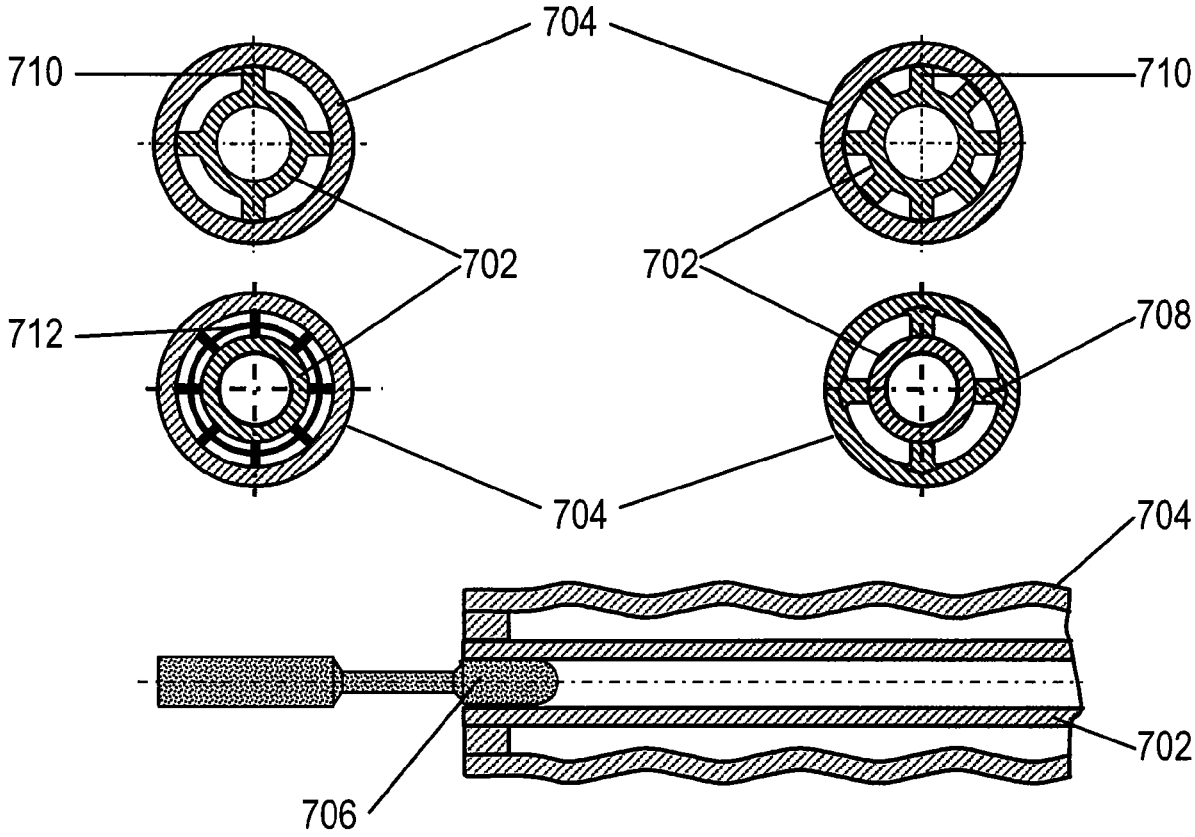
FIG. 7 illustrates a means for increased lamp tube rigidity.

FIG. 7 illustrates another embodiment of the present invention related to mechanical interactions between lamp tube 702 and surrounding cooling jacket 704. Creating connection points between lamp tube 702 and cooling jacket 704 allows converting an otherwise loosely-supported lamp (i.e., only at each end, past electrode(s) 706) into a better supported design that provides an additional dimension of mechanical structure along with support in the central regions of the lamp.

This rigid and stable lamp support design is based on multiple variations and combination of flash lamp components and includes different embodiments of cooling jacket 704 with ring-like or longitudinal ribs 708 contacting and supporting the outside surface of lamp tube 702, the use of non-continuous or continuous exterior ribs 710 upon or integral to lamp tube 702, and the introduction of independent intermediate spacers 712 between lamp tube 702 and cooling jacket 704.

Figure 8:
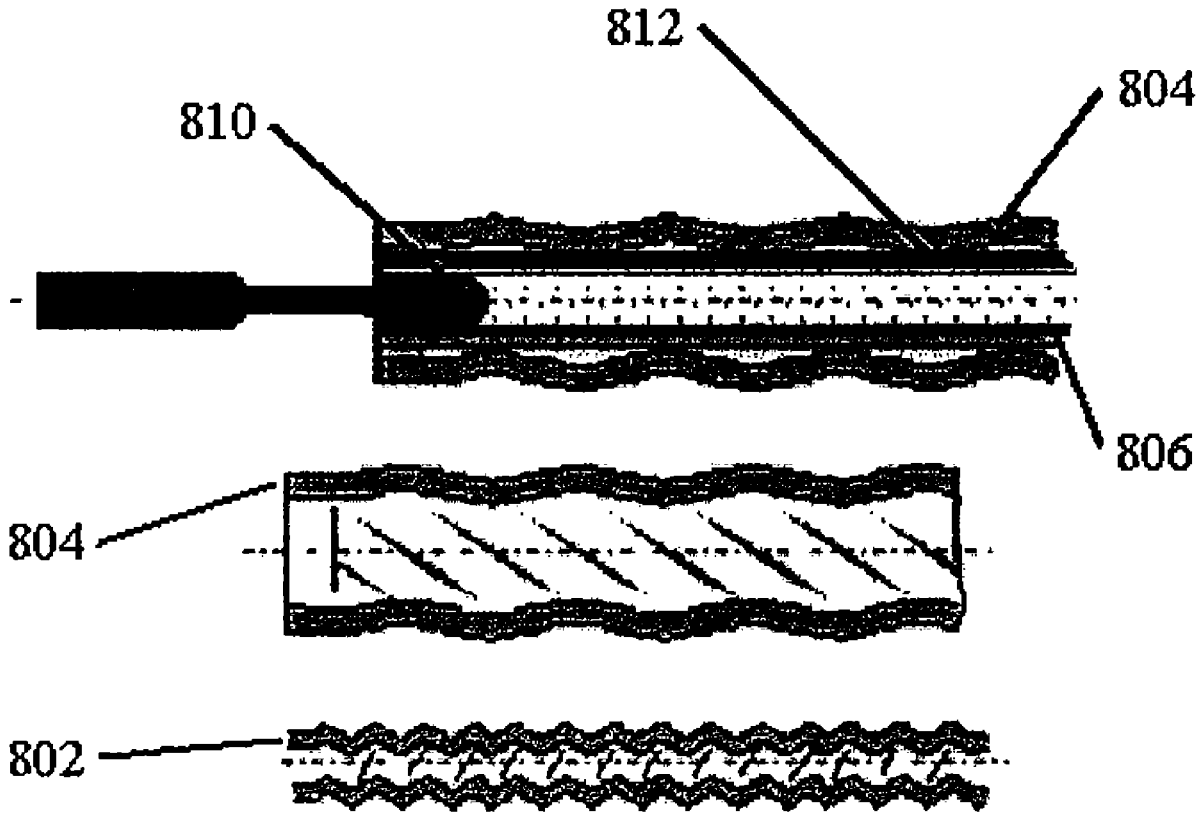
FIG. 8 illustrates the use of spiral components for lamp tube support.

FIG. 8 illustrates various embodiments of flash lamp components based on incorporating either lamp tube 802, or cooling jacket or second tube 804, fabricated with spiral ribs that provide mechanical stability to the lamp tube. An integral lamp assembly may therefore be comprised of a ribbed lamp located inside the smooth inside diameter of a cooling jacket, or else a smooth (non-ribbed) lamp 806 exterior located inside ribbed cooling jacket 804.

Shown at only one of the two lamp ends is lamp tube 806 and electrode 810. In an alternate embodiment, both the lamp tube and the cooling jacket may be fabricated with spiral ribs. Furthermore, fabrication of various styles of lamps can be advantageously simplified by assembling at room temperature the lamp and jacket components as a "slip fit" that, upon the lamp achieving the normal elevated temperature of operation, then creates one or more "interference fit" contact points 812 that provide mechanical support for the lamp. Use of components with twisted and or segmented surfaces, whether of longitudinal or radial orientation, creating contact between the tube and jacket, can help with absorption, reflection, and redirection of shock waves, thereby reducing the stress level in the lamp elements. Various combinations of surface patterns may be utilized to increase the turbulence of the cooling fluid, thereby also increasing the efficiency of the heat transfer.

Figure 9:
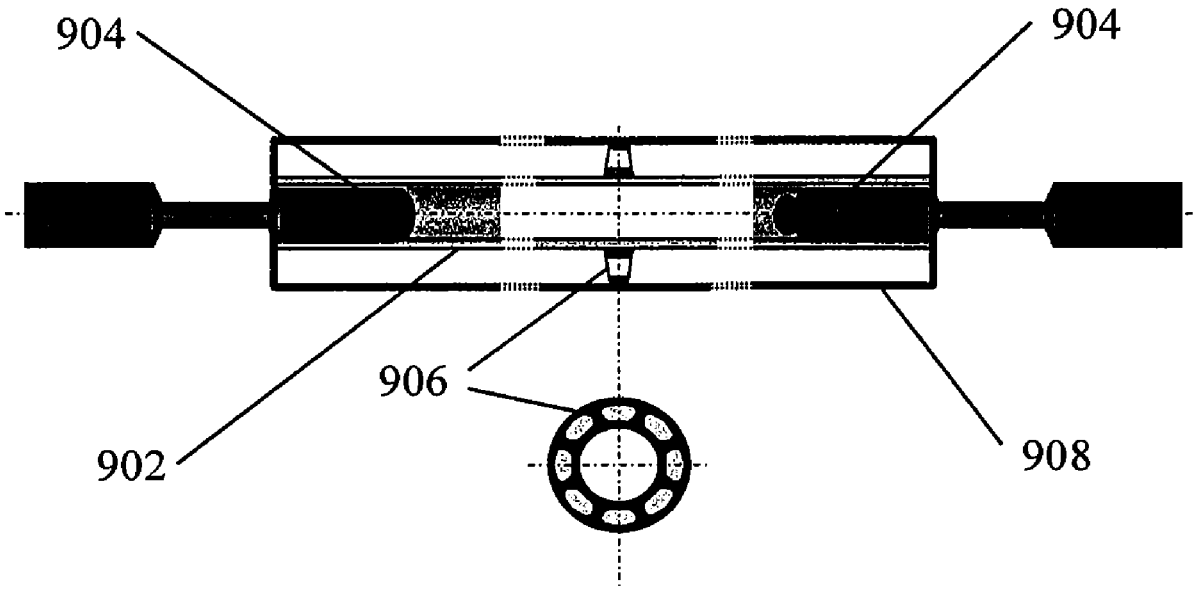
FIG. 9 illustrates a pre-stressed lamp.

FIG. 9 illustrates an embodiment providing mechanical support, wherein the reinforcement of lamp tube 902, shown here with electrode(s) 904, is accomplished as an integral lamp and cooling jacket assembly by inserting multi-lob spacer(s) 906 connecting the walls of lamp tube 902 and cooling jacket 908, thereby creating a 3-dimensionally supported mechanical structure of higher strength and rigidity. The location points of connections are chosen in such a manner that reinforcement areas are able to limit tube natural oscillations and resonance, and also in a manner that provides the possibility for axial and radial preloading of the lamp tube material. This advantageously allows the elimination or reduction of tensile stress in lamp envelope (tube) 902 and limits the extent of tube bulging under the axial load.

Pre-stressed and/or flexible connecting elements (such as spacers) between tube 902 and jacket 908 can provide mechanical stress control and absorption of vibrations caused by shock waves. In one example such flexible connecting element(s) 906 is comprised of any of various suitable materials that are mechanically elastic.

Figure 10:
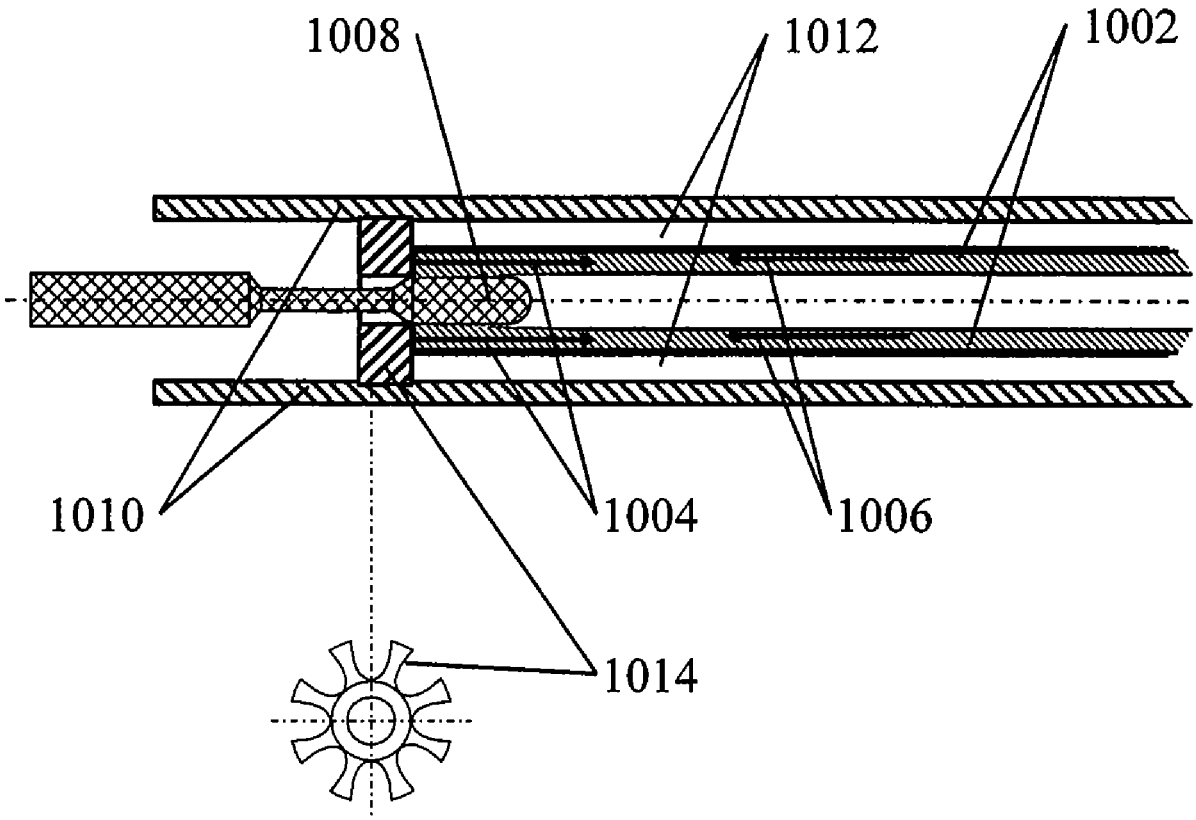
FIG. 10 illustrates axial preload of lamp tube walls.

FIG. 10 illustrates a further embodiment of the present invention, comprising further reduction of deleterious tensile stress in the lamp envelope material by a longitudinal preload of lamp tube walls 1002 during the lamp assembly. Additional compression 1004 force upon tube walls 1002 can prevent development of high-tension stress during multiple pulses of lamp discharge and thereby substantially reduce the chances of micro-crack development in the lamp envelope material. Such compression can be longitudinal compression 1004, along the length of lamp tube 1002 and as illustrated in this example, as well as radial compression, as previously mentioned. In this example, longitudinal compression 1004 acts to counteract the lamp tube longitudinal expansion 1006 that results from the force of shock waves and transient, thermally-induced post-pulse gas pressure loading upon the respective ends of the lamp, at or near electrode(s) 1008. Alternatively, compression forces can be transferred from cooling jacket 1010 to the wall of lamp tube 1002. For example, mechanical connection(s) between cooling jacket 1010 and tube 1002 can mediate axial compression in tube walls.

A pre-stressed, integrated lamp design can be achieved by using one or more pressure rings 1014 at or near each end of lamp tube 1002 as lamp tube longitudinal compression force 1004 loading members. It is possible by this design to modify the lamp assembly process in a manner that will redistribute the axial forces within the components of lamp tube 1002 and convert some of those forces into longitudinal and/or radial tension stress within cooling jacket 1010, thereby balancing and reducing the axial compression stress in the walls of lamp tube 1002.

Preferably, tube 1002 is centered in cooling jacket 1010, for example, utilizing a star-like or radial-armed shape as pressure ring 1014 (see for example the shapes illustrated in FIGS. 7 and 9) allows cooling fluid circulation in annular gap 1012 surrounding lamp tube 1002 and inside cooling jacket 1010. Alternative centering means include but are not limited to afore-mentioned examples such as an inner annular ring contacting the lamp tube, with radial arms extending to and contacting the jacket wall; an outer annular ring in contact with the jacket wall, with radial arms extending inward and contacting the lamp tube wall; a central annular ring located midway between the walls of the lamp tube and jacket, with radial arms extending in both directions and contacting the respective walls.

Yet another embodiment of the present invention comprises reducing the risk of development of excessive tensile stress in tube walls by application of evenly distributed hydraulic pressure along the lamp tube. It is known that higher power pulsed flash lamps typically have channel 1012 between lamp tube 1002 and cooling jacket 1010 whereby cooling fluid is pumped through channel 1012, removing heat from lamp tube 1002. By this invention an intentional substantial pressure increase in cooling fluid can result in uniform radial compression of tube walls 1002, thereby reducing the chances for developing excessive tension stress in the material used for the high performance pulsed lamp tube. In a preferred embodiment, the range of 2 Bar to 7 Bar is beneficial while remaining both achievable and safe to implement.

Figure 11:
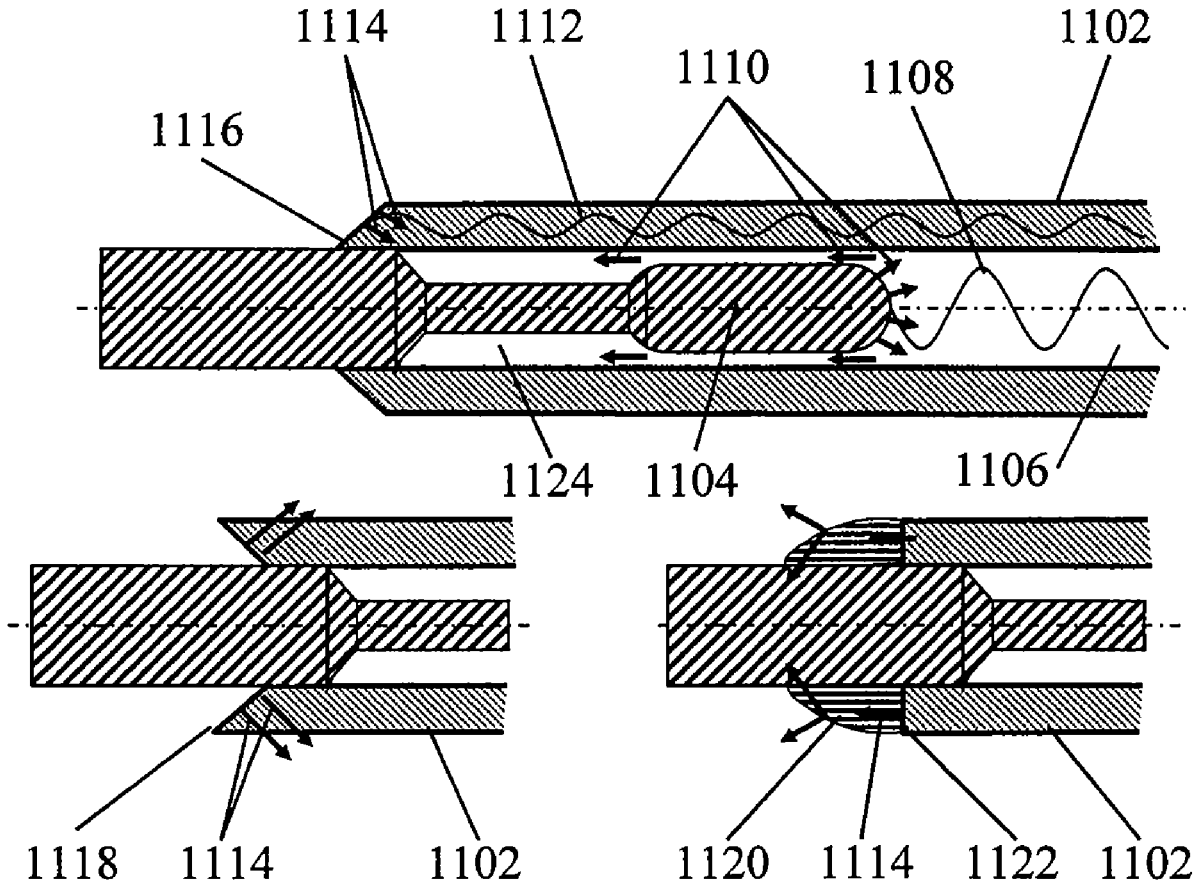
FIG. 11 illustrates a means for suppression of shock waves.

FIG. 11 illustrates a further embodiment, comprising a means to limit the deleterious effect of excessive shock waves in the lamp working gas and material comprising the lamp tube walls. Preferably hollow chamber 1124 is created in the general vicinity of electrode head(s) 1104. For example, in one embodiment turned-down areas on both electrodes 1104 together with the inner wall surface of lamp tube 1102 create small cylindrical hollow chambers 1124 behind electrode head(s) 1104. These chambers are connected with main tube gas volume 1106 by thin clearances between electrode head(s) 1104 and tube inner surface, and can work as a trap for axial shock waves 1110 propagated through the gas inside the tube. It should be mentioned that the previously described wave-like and twisted tubes and jackets are also able to provide irregular hollows working as multiple traps for shock waves within the gas.

Additional modifications of electrode and supporting structure, for example, changing the head shape from flat to spherical and introducing special grooves at the back of the head, can promote additional reflection and dissipation of pressure waves in the lamp gas. Alternatively, additional energy dispersing space(s) can be provided through modifications to the surrounding tube.

FIG. 11 further illustrates flash lamp designs and components responsible for attenuating, redirecting, and diffusing the high energy shock waves (and their harmonics) that propagate through the gases and solid materials of the lamp. Shown is a representation of one end of a pulsed lamp that includes lamp envelope (or tube) 1102, electrode assembly 1104, main tube gas volume 1106, primary high energy shock wave 1108, small arrows representing secondary dispersed shock wave energy components 1110 within gas-filled cavity 1106, lamp tube-coupled shock wave energy 1112 within the solid material of lamp tube 1102, and small arrows representing dispersed shock wave energy 1114 at or near the ends of lamp tube 1102.

In an alternative embodiment resulting cavities, for example cavity or chamber 1124, either include or comprise material having appropriate elastic properties (i.e., similar to some silicone compounds), but need not be limited to only polymers; other material families may also provide compatible characteristics. For example, there are materials exhibiting a compressible structure encompassing voids (similar to a sponge) that are also compatible with the ambient conditions of elevated temperature, high electric stress, high photon flux, and high gas purity.

Chamfered-out (bevel angled-out) sections 1116 and/or chamfered-in (bevel angled-in) sections 1118 at the ends of lamp tube 1002 are able to redirect and/or dissipate shock waves 1112 propagated through the material of lamp tube 1002. In another embodiment, filler 1120 located on lamp tube 1002 tube butt-ends 1122 and made of a shock-compensating material with a density that is between that of the lamp envelope material (preferably glass or quartz) and the cooling medium (typically water) can provide additional absorption and attenuation of lamp tube 1002 shock wave 1112 as it couples into filler 1120.

Various shock absorbing materials and structures located inside the tube (behind the electrode heads) and outside on tube butt-ends are additional embodiments that can improve flash lamp lifetime and performance.

Additionally, an increase in the internal diameter of lamp tube 1102 will increase the amount of gas while simultaneously decreasing the tube temperature and effect of shock waves. Importantly, the additional and possibly negative effects that such a change might impose upon the formation and density of the plasma can be entirely mitigated by one or some combination of other teachings and claims of this invention. For example, the afore-mentioned ground current return scheme illustrated in FIG. 4 is one such means whereby the plasma column may be advantageously shaped to achieve the desired conditions.

All suggestions related to more efficient cooling of lamp electrodes could work in combination with embodiments set forth herein that focus upon reduction of the effect of shock waves and/or envelope reinforcement elements.

Figure 12:
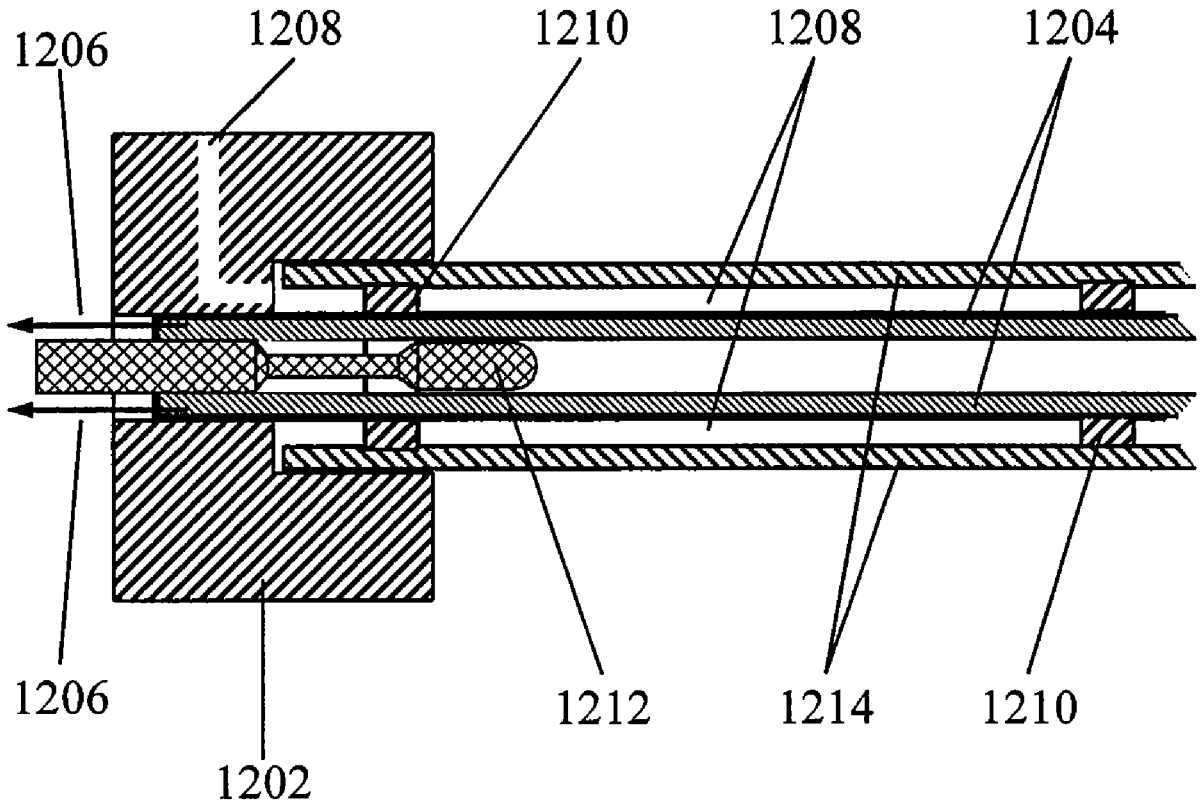
FIG. 12 illustrates a lamp holder with sliding tube.

FIG. 12 illustrates an additional embodiment comprising the reduction of excessive longitudinal and axial stress in tube material as a result of repetitive high-energy pulses and lamp tubing thermal expansion. In this embodiment lamp tube holder 1202 located beyond electrode head 1212 at each end of lamp tube 1204 can be constructed with suitable flexible coolant seals in order to provide an opportunity for lamp tube 1204 to slide in longitudinal direction 1206, thereby reducing possible excessive longitudinal and axial load on the walls of lamp tube 1204 and cooling envelope 1214. Thus, in this embodiment, lamp tube holders 1202 allow lamp tube 1204 to slide in response to thermal expansion and/or high energy pulses, while also providing a means whereby coolant fluid can be pumped into, throughout, and out of lamp coolant channels 1208. Radial-armed supporting spacers 1210 located in coolant channels 1208 are constructed so as to provide both axial support to and longitudinal slip for lamp tube 1204, in addition to passages allowing adequate cooling fluid flow.

Figure 13:
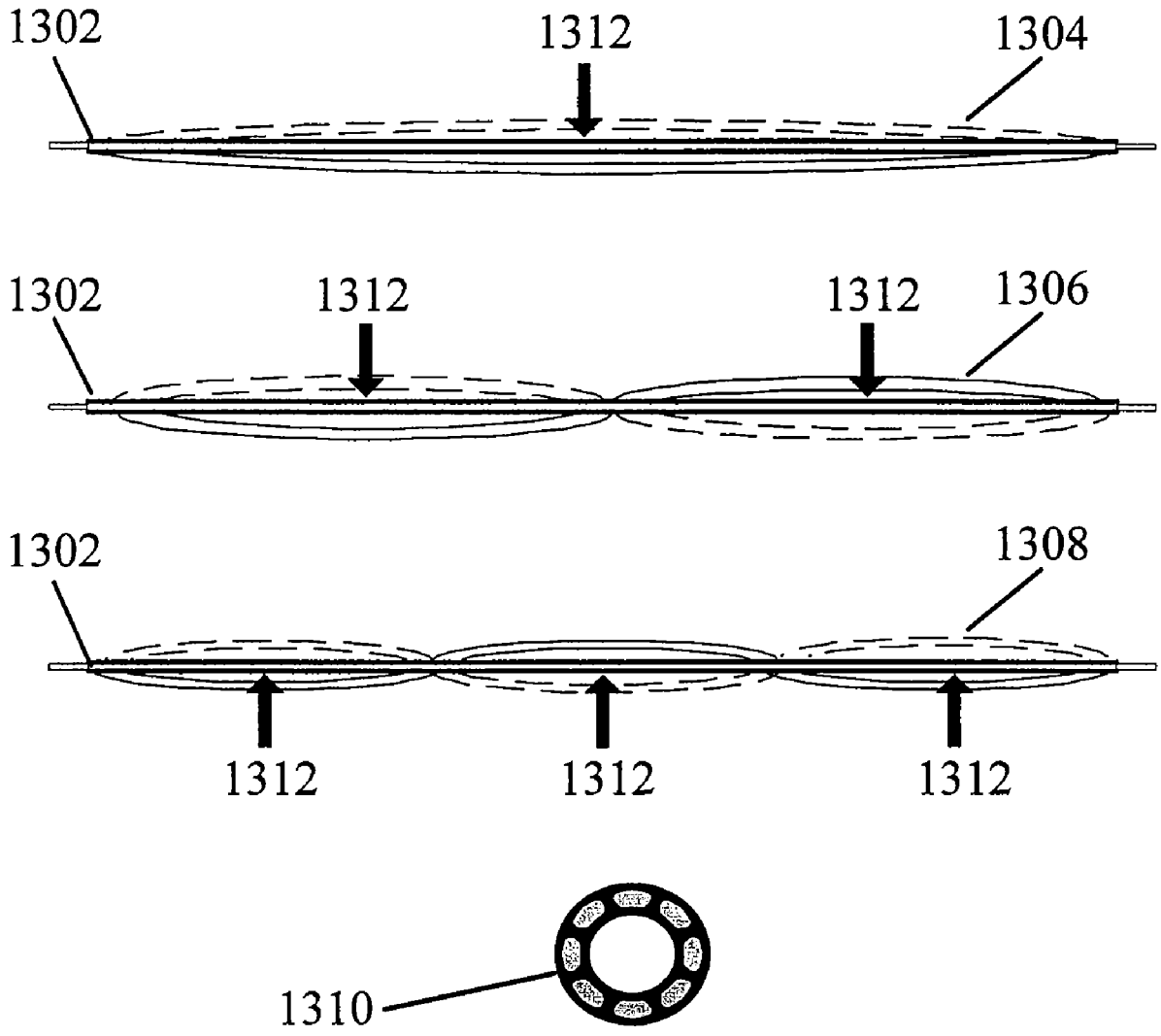
FIG. 13 illustrates a means for suppression of resonant waves.

FIG. 13 illustrates the use of the afore-mentioned supporting spacer(s) 1310 located in area(s) of lamp tube 1302 resonant wave anti-node 1312 (maxim amplitudes) in order to limit the natural oscillations of lamp tube 1302, thereby preventing excessive resonance-induced stress. Supporting spacers 1310 are placed around the circumference of lamp tube 1302, extending in a radial direction to the inside wall of a cooling jacket, and are positioned as required at appropriate anti-node position(s) 1312 along the length of lamp tube 1302, thereby mechanically stiffening the lamp. The first mode of vibration resonance wave 1304, second mode of vibration resonance wave 1306, and third mode of vibration resonance wave 1308 are illustrated, as are their respective anti-node positions 1312. In certain more demanding applications, avoiding resonance and possible excessive deflection of tube components can be advantageous and instrumental in the reduction of development of micro-cracks in the lamp tube, thereby preventing premature failure and/or unacceptable pulsed lamp lifetime.

For the purpose of providing either thermal conductance or the transference of mechanical forces between the lamp tube and cooling jacket, the utilization of connecting and/or compression ring material(s) with intentionally mismatched coefficient of thermal expansion can be advantageous. This method makes use of the differential temperatures between the lamp tube outer surface and the cooling jacket inner surface, and thereby creates a thermal "shrink-fit" with a subsequent intimate physical surface contact between components (lamp tube, rings, and cooling jacket. The amount of compression force upon each can be accurately tailored by the selection of materials and lamp cooling operating parameters. Additionally, a "slip-fit" condition during manufacturing can advantageously become a compressed fit at the more elevated temperature required during lamp system operation.

Having now described a few embodiments of the invention, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention and any equivalent thereto. It can be appreciated that variations to the present invention would be readily apparent to those skilled in the art, and the present invention is intended to include those alternatives. Further, since numerous modifications will readily occur to those skilled in the art, it is not desired to limit the invention to the exact construction and operation illustrated and described, and accordingly, all suitable modifications and equivalents may be resorted to, falling within the scope of the invention.

What is claimed is:

1. A pulsed flash lamp, wherein said pulsed flash lamp is a pulsed broadband lamp and/or a pulsed ultraviolet (PUV) lamp comprising:

a lamp tube, said lamp tube comprising a radiation transparent material, an inner lamp tube surface, an outer lamp tube surface, a first lamp tube end and a second lamp tube end;

a gas, said gas residing within said lamp tube; and at least one electrode(s), said electrode(s) residing as least partially within said lamp tube, from which said electrode(s) emanates an electrical discharge in said gas, said discharge having a direction and said discharge creating a plasma channel; said lamp further comprising at least one of:

a means for providing resistance to forces due to power loading;

a means for enhancing lamp rigidity and strength;

a means for preventing tube resonant oscillations;

a means for reducing tension load in said lamp tube;

a means to limit axial compression forces on said lamp tube; or a means to absorb, suppress and/or redirect shock waves.

2. The pulsed broadband and/or ultraviolet (PUV) lamp according to claim 1, said lamp tube further comprising alternate lamp tube design, said alternate lamp tube design comprising at least one of:

said inner surface or said outer surface further comprising rib(s), at least one of said rib(s) selected from the group of rib types consisting of longitudinal ribs, ring ribs, spiral ribs, outer surface ribs, annular ring ribs, and discontinuous rib(s);

said inner surface or said outer surface further comprising protrusion(s);

said inner surface or said outer surface further comprising depression(s), at least one of said depression(s) selected from the group of depression types consisting of longitudinal depression(s), ring depression(s), spiral depression(s), outer surface depression(s), annular ring depression(s), and discontinuous depression(s);

said lamp tube further comprising a cross-section selected from the group of cross-sections consisting of round, non-round, elliptical, oval, triangular, rectangular, polyhedron, polyhedron with rounded corners, and diamond;

said lamp tube is twisted in a longitudinal direction; or said lamp tube has wave-like surfaces.

3. The pulsed broadband and/or ultraviolet (PUV) lamp according to claim 1, further comprising:

at least one second tube, wherein said lamp tube is inside at least part of said second tube or wherein said second tube is over at least part of said lamp tube, and said second tube comprising an inner second tube surface and an outer second tube surface; and a channel between said lamp tube and said second tube.

4. The pulsed broadband and/or ultraviolet (PUV) lamp according to claim 3 wherein said second tube encompasses at least a portion of said at least one electrode(s).

5. The pulsed broadband and/or ultraviolet (PUV) lamp according to claim 3, said inner second tube surface comprising rib(s), wherein said rib(s) are in proximity to or contact with said outer lamp tube surface in at least one location.

6. The pulsed broadband and/or ultraviolet (PUV) lamp according to claim 3, said outer lamp tube surface comprising rib(s), wherein said rib(s) are in proximity to or contact with said inner second tube surface in at least one location.

7. The pulsed broadband and/or ultraviolet (PUV) lamp according to claim 3, said second tube inner surface comprising at least one of longitudinal rib(s), ring rib(s), spiral rib(s), outer surface rib(s), annular ring rib(s), discontinuous rib(s), longitudinal depression(s), ring depression(s), spiral depression(s), outer surface depression(s), annular ring depression(s), discontinuous depression(s) or protrusion(s).

8. The pulsed broadband and/or ultraviolet (PUV) lamp according to claim 3, said lamp tube and said second tube each comprising spiral ribs, wherein said spiral ribs of said lamp tube and said spiral ribs of said second tube each spiral in the same direction or each spiral in different directions.

9. The pulsed broadband and/or ultraviolet (PUV) lamp according to claim 3, said lamp tube or said second tube further comprising ribs, said ribs providing at least partial contact between said lamp tube and said second tube.

10. The pulsed broadband and/or ultraviolet (PUV) lamp according to claim 3, comprising:

spacer(s), wherein said lamp tube and said second tube are at least intermittently connected by said spacer(s) and wherein said spacer(s) mediate at least one of radial compression in at least one point of said lamp tube, or axial compression in at least one point of said lamp tube.

11. The pulsed broadband and/or ultraviolet (PUV) lamp according to claim 10, said spacer(s) comprising elastic.

12. The pulsed broadband and/or ultraviolet (PUV) lamp according to claim 10 wherein said spacer(s) are at least one of pre-stressed or flexible.

13. The pulsed broadband and/or ultraviolet (PUV) lamp according to claim 3, comprising element(s), wherein said element(s) transfer compression from said second tube to said lamp tube.

14. The pulsed broadband and/or ultraviolet (PUV) lamp according to claim 13 wherein said element(s) further comprise a centering means for centering said lamp tube in said second tube.

15. The pulsed broadband and/or ultraviolet (PUV) lamp according to claim 3, said channel further comprising a cooling agent, wherein said cooling agent is pressurized.

16. The pulsed broadband and/or ultraviolet (PUV) lamp according to claim 15, wherein said cooling agent is pressurized to at least 2 Bar.

17. The pulsed broadband and/or ultraviolet (PUV) lamp according to claim 1, further comprising:

shock absorbing means, wherein said shock absorbing means reside within said lamp tube.

18. The pulsed broadband and/or ultraviolet (PUV) lamp according to claim 1, said electrode(s) further comprising:

a head;

a midsection; and a tail, said head being connectable or connected to said midsection and said midsection being connectable or connected to said tail; wherein said electrode(s) is centered within said lamp tube; wherein said midsection of said electrode(s) has a smaller circumference than said head of said electrode(s), resulting in a greater annular space between said midsection and said lamp tube than between said head and said lamp tube, and wherein said gas resides within said annular space.

19. The pulsed broadband and/or ultraviolet (PUV) lamp according to claim 18, at least a portion of said annular space comprising a shock absorbing means.

20. The pulsed broadband and/or ultraviolet (PUV) lamp according to claim 1, wherein at least one of said first lamp tube end or said second lamp tube end are chamfered-out or chamfered-in having an inclination in radial, axial or both directions.

21. The pulsed broadband and/or ultraviolet (PUV) lamp according to claim 20 comprising shock wave dissipation and redirection means, wherein said shock wave dissipation and redirection means contact at least one of said first lamp tube end or said second lamp tube end and comprise a material of intermediate density between quartz or glass and cooling medium.

22. The pulsed broadband and/or ultraviolet (PUV) lamp according to claim 1 further comprising:

lamp ends holder(s), wherein said holder(s) allow the lamp to slide under the action of thermal expansion and/or high energy pulses.

23. The pulsed broadband and/or ultraviolet (PUV) lamp according to claim 1 further comprising:

ground current return means, wherein said ground current return means reverse current direction to and coaxial with said plasma channel and wherein said ground current return means are located at a pre-defined distance, wherein said predefined distance is optimized to at least one factor selected from the group of factors consisting of plasma spatial location, plasma current cross-section shape, plasma proximity to said inner surface, plasma current size, plasma temperature, plasma current electron density, and spectral output.

24. The pulsed broadband and/or ultraviolet (PUV) lamp according to claim 23 wherein said ground current return means are a symmetrical array of external metal conductors or a radial array of parallel conductors.

25. A pulsed flash lamp comprising:

a lamp tube, said lamp tube comprising a radiation transparent material having an inner lamp tube surface, an outer lamp tube surface, a first lamp tube end and a second lamp tube end;

a gas, said gas residing within said lamp tube;

at least two electrodes, said electrodes residing as least partially within said lamp tube, wherein electrical current between said at least two electrode produces an electrical discharge in said gas, said discharge having a direction;

at least one second tube, wherein said lamp tube is inside at least part of said second tube or wherein said second tube is over at least part of said lamp tube, and said second tube comprising an inner second tube surface and an outer second tube surface; and a channel between said lamp tube and said second tube; said pulsed flash lamp further comprising at least one of:

a means for providing resistance to forces due to multiple pulse power loading;

a means for enhancing lamp rigidity and strength;

a means for preventing tube resonant oscillations;

a means for reducing tension load in said lamp tube;

a means to limit axial compression forces on said lamp tube; or a means to absorb, suppress and/or redirect shock waves.

* * * * *